US011856677B2

(12) United States Patent
Mironov et al.

(10) Patent No.: US 11,856,677 B2
(45) Date of Patent: Dec. 26, 2023

(54) SUSCEPTOR ASSEMBLY FOR AEROSOL GENERATION COMPRISING A SUSCEPTOR TUBE

(71) Applicant: Philip Morris Products S.A., Neuchatel (CH)

(72) Inventors: Oleg Mironov, Cudrefin (CH); Jerome Christian Courbat, Cortaillod (CH); Enrico Stura, Palézieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 609 days.

(21) Appl. No.: 17/057,430

(22) PCT Filed: May 24, 2019

(86) PCT No.: PCT/EP2019/063534
§ 371 (c)(1),
(2) Date: Nov. 20, 2020

(87) PCT Pub. No.: WO2019/224380
PCT Pub. Date: Nov. 28, 2019

(65) Prior Publication Data

US 2021/0204604 A1 Jul. 8, 2021

(30) Foreign Application Priority Data

May 25, 2018 (EP) ..... 18174209

(51) Int. Cl.
*H05B 6/10* (2006.01)
*A24F 40/465* (2020.01)
(Continued)

(52) U.S. Cl.
CPC ..... *H05B 6/105* (2013.01); *A24F 40/465* (2020.01); *H05B 6/108* (2013.01); *A24F 40/10* (2020.01); *A24F 40/42* (2020.01); *A24F 40/48* (2020.01)

(58) Field of Classification Search
CPC ..... H05B 6/105; H05B 6/108; A24F 40/465; A24F 40/48
(Continued)

(56) References Cited

U.S. PATENT DOCUMENTS 5,410,132 A * 4/1995 Gregg ..... B23K 20/023 219/602
5,613,505 A * 3/1997 Campbell ..... A24F 40/53 131/194
(Continued)

FOREIGN PATENT DOCUMENTS

CN 1126426 A 7/1996
CN 101682941 A 3/2010
(Continued)

OTHER PUBLICATIONS

Russian Notice of Allowance dated Jul. 7, 2022 in Russian Patent Application No. 2020141196 (with unedited computer generated English translation), 14 pages.
(Continued)

*Primary Examiner* — Alexander Gilman
(74) *Attorney, Agent, or Firm* — Oblon, McClelland, Maier & Neustadt, L.L.P.

(57) ABSTRACT

A susceptor assembly for inductively heating an aerosol-forming substrate is provided, the susceptor assembly including a multi-layer susceptor tube defining a cavity configured to receive an induction coil inside the multi-layer susceptor tube, the multi-layer susceptor tube includes an inner tubular layer, which includes a first electrically con-
(Continued)

ductive material, and an outer tubular layer surrounding the inner tubular layer, which includes a second electrically conductive material, and an electrical resistivity of the first electrically conductive material is greater than an electrical resistivity of the second electrically conductive material. An inductive heating assembly for inductively heating an aerosol-forming substrate, an aerosol-generating article for an aerosol-generating device, and an aerosol-generating system are also provided.

21 Claims, 4 Drawing Sheets

(51) Int. Cl.
*A24F 40/10* (2020.01)
*A24F 40/42* (2020.01)
*A24F 40/48* (2020.01)

(58) Field of Classification Search
USPC ..... 131/329
See application file for complete search history.

(56) References Cited

U.S. PATENT DOCUMENTS 5,698,124 A * 12/1997 DiMarcello ..... H05B 6/22 373/137
5,878,752 A * 3/1999 Adams ..... A24F 40/465 131/194
6,304,590 B1 * 10/2001 Roberts ..... B22D 11/008 219/605
2002/0117965 A1 * 8/2002 Kotter ..... H01J 9/266 313/573
2015/0335071 A1 * 11/2015 Brinkley ..... H05B 1/0297 392/390
2016/0150825 A1 * 6/2016 Mironov ..... A24F 40/46 219/634
2017/0055583 A1 * 3/2017 Blandino ..... H05B 6/36
2017/0105452 A1 * 4/2017 Mironov ..... A24F 40/465
2017/0127722 A1 * 5/2017 Davis ..... A24F 40/95
2017/0188636 A1 * 7/2017 Li ..... H05B 6/362
2019/0127878 A1 * 5/2019 Mantese ..... B22D 27/02
2019/0208813 A1 * 7/2019 Rojo-Calderon ..... A24D 1/20
2021/0204604 A1 * 7/2021 Mironov ..... A24F 40/465
2022/0132908 A1 * 5/2022 Batista ..... A24D 1/20 131/280
2022/0369714 A1 * 11/2022 Butin ..... A24F 40/57
2023/0210185 A1 * 7/2023 Mironov ..... A24F 40/20 131/329
2023/0210188 A1 * 7/2023 Courbat ..... A24F 40/42 131/329

FOREIGN PATENT DOCUMENTS

CN 102017790 A 4/2011
CN 103180117 A 6/2013
CN 203762288 U 8/2014
CN 105451582 A 3/2016
CN 106455715 A 2/2017
CN 106659237 A 5/2017
CN 107708452 A 2/2018
EP 3 110 270 A 1/2017
RU 2 606 866 C1 1/2017
RU 2 645 205 C1 2/2018
WO WO 2015/131058 A1 9/2015
WO WO 2016/208756 A1 12/2016
WO WO 2017/001818 A1 1/2017
WO WO 2017/068094 A1 4/2017
WO WO 2017/068099 A1 4/2017

OTHER PUBLICATIONS

Russian Search Report dated Jul. 7, 2022 in Russian Patent Application No. 2020141196 (with unedited computer generated English translation), 4 pages.
Japanese Office Action dated Mar. 20, 2023 in Japanese Patent Application No. 2020-565738 (with English Translation), 5 pages.
Combined Chinese Office Action and Search Report dated Sep. 30, 2022 in Chinese Patent Application No. 201980029288.6 (with English Translation), 20 pages.
International Search Report and Written Opinion dated Aug. 16, 2019 in PCT/EP2019/063534 filed on May 24, 2019.

* cited by examiner

SUSCEPTOR ASSEMBLY FOR AEROSOL GENERATION COMPRISING A SUSCEPTOR TUBE

The present invention relates to a susceptor assembly for generating an aerosol from an aerosol-forming substrate. The invention further relates to an inductive heating assembly, an aerosol-generating article and an aerosol-generating system comprising such a susceptor assembly.

Aerosol-generating systems based on induction heating of aerosol-forming substrates are generally known from prior art. Typically, these systems comprise an induction source including an induction coil to generate an alternating magnetic field for inducing heat generating eddy currents and/or hysteresis losses in a susceptor element. The susceptor element is in thermal proximity of or contact with the substrate being capable of releasing volatile compounds upon heating such as to form an aerosol. The susceptor element and the aerosol-forming substrate may be provided together in an aerosol-generating article configured for use with an aerosol-generating device which in turn may include the induction source. While induction heating in general is highly efficient, many inductively heated aerosol-generating systems only have a poor load factor for converting energy provided by the alternating magnetic field into heat.

Therefore, it would be desirable to have a susceptor assembly and an induction heating assembly, respectively, with the advantages of prior art solutions but without their limitations. In particular, a susceptor assembly and an induction heating assembly would be desirable which are capable of using the energy provided by the alternating magnetic field more efficiently.

According to the invention there is provided a susceptor assembly for inductively heating an aerosol-forming substrate. The susceptor assembly comprises a multi-layer susceptor tube defining a cavity for receiving an induction coil inside the susceptor tube. The multi-layer susceptor tube comprises an inner tubular layer and an outer tubular layer surrounding the inner tubular layer. The inner tubular layer includes, preferably consists of a first electrically conductive material, whereas the outer tubular layer includes, preferably consists of a second electrically conductive material. An electrical resistivity of the first electrically conductive material is larger than an electrical resistivity of the second electrically conductive material.

According to the invention it has been recognized that in many aerosol-generating systems a vast majority of the alternating magnetic field generated by the induction source largely spreads beyond the dimensions of the susceptor element. Accordingly, a substantial portion of the field energy is unused, that is, not converted into heat and, thus, wasted.

To provide remedy, the susceptor assembly according to the present invention comprises a susceptor tube, that is, a tubular susceptor element. Advantageously, the tube shape allows for arranging an induction coil of an induction source within the cavity that is defined by the inner void of the tube. Accordingly, the induction coil is (at least laterally or even fully) enclosed within the susceptor tube along the length extension of the susceptor tube, in particular such that a majority of the magnetic field generated by the induction coil is also substantially enclosed within the susceptor tube. As a result, the portion of the magnetic field that is effectively couplable to the susceptor tube is significantly increased. Furthermore, arranging the induction coil within the cavity of the susceptor tube also proves advantageous with regard to a compact design of the aerosol-generating system.

Moreover, coupling of the alternating magnetic field to the susceptor tube is further increased due to the multi-layer configuration of the susceptor tube, that is, due to the inner and outer tubular layer including a first and second electrically conductive material, respectively, having different resistivities. As the first material of the inner layer has a larger resistivity than the second material of the outer layer, or vice versa, as the second material of the outer layer has a larger conductivity than the first material of the inner layer, the outer layer substantially serves to concentrate/block the alternating magnetic field due to its larger conductivity. In contrast, the inner layer mainly serves to convert the energy of the magnetic field into heat due to its higher resistivity.

Preferably, the electrical resistivity of the first electrically conductive material is at least 2.5×10E-08 Ohm-meter, in particular at least 5.0×10E-08 Ohm-meter, preferably at least 5.0×10E-07 Ohm-meter at a temperature of 20° C. Advantageously, these resistivity ranges ensure sufficient heating due to the Joule effect. Vice versa, the electrical resistivity of the second electrically conductive material preferably is below 5.0×10E-07 Ohm-meter, in particular below 5.0×10E-08 Ohm-meter, preferably below 2.5×10E-08 Ohm-meter at a temperature of 20° C. Advantageously, these resistivity ranges enable sufficient concentration/blocking of the magnetic field.

Preferably, the electrical resistivity of first electrically conductive material is no more than 1.5×10E-06 Ohm-meter at a temperature of 20° C.

As used herein an "electrically conductive material" means a material that has an electrical conductivity of at least 1×10E6 Siemens per meter.

Enhancement of the above described effects, in particular an enhanced coupling of the alternating magnetic field to the susceptor tube, may be achieved by increasing the difference between the resistivities of the first and second materials. Accordingly, the electrical resistivity of the first electrically conductive material may be at least two times, in particular at least five times, preferably at least ten times larger than the electrical resistivity of the second electrically conductive material.

Preferably, at least one of the first and second electrically conductive materials comprises a metallic material, in particular is metallic. Accordingly, at least one of the first or the second electrically conductive materials may comprise or consist of ferritic iron, or a paramagnetic or ferromagnetic metal or metal alloy, such as aluminium or steel, in particular ferromagnetic steel, preferably ferromagnetic stainless steel. At least one of the first and second electrically conductive materials may also comprise or may be made of austenitic steel, austenitic stainless steel, graphite, molybdenum, silicon carbide, niobium, Inconel alloys (austenite nickel-chromium-based super-alloys), metallized films, or electrically conductive ceramics.

In general, the first and second electrically conductive materials do not need to be magnetic, that is, the first and second electrically conductive material may be paramagnetic. In this case, inductive heating, in particular within the first material of the inner tubular layer, is only due to the Joule heating generated by eddy currents that are induced by the alternating magnetic field.

Heating can be further increased, if at least one of the first and second electrically conductive materials are magnetic, that is, ferromagnetic or ferrimagnetic. In this case, heat may also be generated by hysteresis losses due to magnetic domains within the magnetic material being switched under the influence of the alternating magnetic field. Accordingly, at least one of the first and second electrically conductive materials may be ferromagnetic or ferrimagnetic.

Furthermore, the inner tubular layer may an innermost layer of the multi-layer susceptor tube and/or wherein the outer tubular layer is an outermost layer of the multi-layer susceptor tube. Yet further, the inner tubular layer and the outer tubular layer may be adjacent layers in direct contact with each other. In particular, the multi-layer susceptor tube may be a two-layer susceptor tube, wherein the inner tubular layer and the outer tubular layer are adjacent layers, preferably in direct contact with each other.

In many inductively heated aerosol-generating systems, the aerosol-forming substrate is in close contact with the susceptor element. Accordingly, the susceptor tube of the susceptor assembly according to the present invention may be fluid permeable, in particular perforated, and/or may comprise at least one opening, such as to allow aerosol-forming substrate vaporized in close proximity to the susceptor tube to readily escape from the substrate through the susceptor tube. For example, at least one of the inner and outer tubular layers may include a tubular mesh comprising or consisting of a first or second electrically conductive material, respectively. This proves particularly advantageous in case the cavity, that is, the inner void of the susceptor tube is in fluid communication with an airflow passage through the aerosol-generating system or in case an airflow passage of the aerosol-generating system—having a susceptor assembly according to the present invention—passes through the cavity of the susceptor tube. Accordingly, with reference to a specific aspect of the invention, the cavity of the susceptor tube may provide an airflow passage.

Furthermore, the susceptor assembly may comprise at least one end cover arranged at an axial end face of the multi-layer susceptor tube. Advantageously, such an end cover enhances enclosure of the magnetic field within the susceptor assembly and thus enhances coupling of the magnetic field to the susceptor assembly.

Like the susceptor tube, the end cover may also be a multi-layer end cover. The multi-layer end cover may comprise an inner end cover layer including, in particular consisting of a first electrically conductive material, which preferably is the same material as the first electrically conductive material of the inner tubular layer of the susceptor tube. In addition, the multi-layer end cover may comprise an outer end cover layer including, in particular consisting of a second electrically conductive material, which preferably is the same material as the second electrically conductive material of the outer tubular layer of the susceptor tube. Likewise, an electrical resistivity of the first electrically conductive material of the inner end cover layer may be larger than an electrical resistivity of the second electrically conductive material of the outer end cover layer.

To still allow vaporized aerosol-forming substrate to readily pass through and escape from the inner cavity of the susceptor, the end cover may be fluid permeable, in particular may comprise at least one opening and/or may be perforated.

According to another aspect of the invention, there is provided an inductive heating assembly for inductively heating an aerosol-forming substrate. The heating assembly comprises a susceptor assembly according to the invention and as described herein. The heating assembly further comprises an induction coil coaxially arranged or arrangeable inside the cavity of the multi-layer susceptor tube, in particular such as to be fully enclosed within the multi-layer susceptor tube. Accordingly, a height or axial length extension of the susceptor tube may be equal to or larger than a height or axial length extension of the induction coil.

In general, the induction coil may be integral part of an aerosol-generating article which comprises a heating assembly according to one of the first or second aspect. Alternatively, the induction coil may be integral part of an aerosol-generating device, wherein the device may be configured for use with an aerosol-generating article which preferably comprises the other parts of the heating assembly (apart from the induction coil), in particular the susceptor assembly.

The induction coil may have a shape substantially matching the shape of the susceptor tube, in particular the shape of the cavity defined by the inner void of the susceptor tube. Preferably, the induction coil is a helical coil or a flat spiral coil, in particular a flat pancake coil or a "curved" planar coil. Use of a flat spiral coil allows for compact design that is robust and inexpensive to manufacture. Use of a helical induction coil advantageously allows for generating a homogeneous alternating magnetic field. The induction coil may be wound around a preferably cylindrical coil support, for example ferrite core. As used herein a "flat spiral coil" means a coil that is generally planar coil wherein the axis of winding of the coil is normal to the surface in which the coil lies. The flat spiral induction can have any desired shape within the plane of the coil. For example, the flat spiral coil may have a circular shape or may have a generally oblong or rectangular shape. However, the term "flat spiral coil" as used herein covers coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil.

The induction coil can be held within one of a housing of the heating assembly, or a housing of an aerosol-generating article, or a main body of an aerosol-generating device or a housing of an aerosol-generating device.

Preferably, the induction coil does not need to be exposed to the generated aerosol. Thus, deposits on the coil and possible corrosion can be prevented. In particular, the induction coil may comprise a protective cover or layer.

The induction coil may have a diameter in the range of 2 millimeter to 10 millimeter, in particular of 3 millimeter to 8 millimeter, preferably of 5 millimeter. Such values prove advantageous with regard to a compact design of the aerosol-forming substrate.

To further enhance conversion of the energy provided by the magnetic field into heat, a minimum radial distance between the multi-layer susceptor tube and the induction coil—when being arranged inside the susceptor tube—advantageously is in the range of 0.05 millimeter to 0.3 millimeter, in particular of 0.1 millimeter to 0.2 millimeter.

Further features and advantages of the inductive heating assembly according to the invention have been described with regard to susceptor assemblies according to the present invention and as described herein. Therefore, these further features and advantages will not be repeated.

According to yet another aspect of the invention there is provided aerosol-generating article for use with an aerosol-generating device. The article comprises at least one aerosol-forming substrate as well as at least one susceptor assembly according to the present invention and as described herein. The susceptor assembly is in thermal contact with at least a portion of the aerosol-forming substrate.

As used herein, the term "aerosol-generating article" refers to an article comprising an aerosol-forming substrate that, when heated, releases volatile compounds that can form an aerosol. Preferably, the aerosol-generating article is a heated aerosol-generating article. That is, an aerosol-generating article which comprises an aerosol-forming substrate that is intended to be heated rather than combusted in order to release volatile compounds that can form an aerosol. The aerosol-generating article may be a consumable, in particular a consumable to be discarded after a single use. For example, the article may be a cartridge including a liquid aerosol-forming substrate to be heated. Alternatively, the article may be a rod-shaped article, in particular a tobacco article, resembling conventional cigarettes.

Preferably, the aerosol-generating article is designed to engage with an electrically-operated aerosol-generating device comprising an induction source. The induction source, or inductor, generates an alternating magnetic field for heating the susceptor assembly of the aerosol-generating article when located within the alternating magnetic field. In use, the aerosol-generating article engages with the aerosol-generating device such that the susceptor assembly is located within the alternating magnetic field generated by the inductor.

As used herein, the term "aerosol-generating device" is used to describe an electrically operated device that is capable of interacting with at least one aerosol-forming substrate of an aerosol-generating article such as to generate an aerosol by heating the substrate. Preferably, the aerosol-generating device is a puffing device for generating an aerosol that is directly inhalable by a user thorough the user's mouth. In particular, the aerosol-generating device is a hand-held aerosol-generating device.

As used herein, the term "aerosol-forming substrate" relates to a substrate capable of releasing volatile compounds that can form an aerosol upon heating the aerosol-forming substrate. The aerosol-forming substrate is part of the aerosol-generating article. The aerosol-forming substrate may be a solid or, preferably, a liquid aerosol-forming substrate. In both cases, the aerosol-forming substrate may comprise at least one of solid and liquid components. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

As mentioned above, the aerosol-forming substrate of the aerosol-generating article preferably is a liquid aerosol-forming substrate, that is, an aerosol-forming liquid. In this configuration, the article preferably further comprises a ring-shaped liquid retention element that is circumferentially arranged around the multi-layer susceptor tube and that is configured for holding and transporting at least a portion of the aerosol-forming liquid.

As used herein, the term "liquid retention element" refers to a transporting and storage medium for aerosol-forming liquid. Thus, aerosol-forming liquid stored in the liquid retention element may be easily transferred to the susceptor element, for example by capillary action. To ensure sufficient vaporization of the aerosol-forming liquid, the liquid retention element advantageously is in direct contact to or at least in close proximity with the susceptor element.

Preferably, the liquid retention element comprises or consists of capillary material. Even more preferably, the liquid retention element may comprise or consist of a high retention or high release material (HRM) for holding and transporting aerosol-forming liquid. Furthermore, the liquid retention element may be at least one of electrically non-conductive and paramagnetic or diamagnetic. Even more preferably, the liquid retention element is inductively non-heatable. Thus, the liquid retention element advantageously is unaffected or only minimally affected by the alternating magnetic field used for inducing heat generating eddy currents and/or hysteresis losses in the susceptor element. For example, the liquid retention element may comprise or consist of glass fiber material.

As the liquid retention element is circumferentially arranged around the multi-layer susceptor tube, preferably only an inner ring portion of the retention element is heated. Such locally confined heating proves advantageous as the aerosol-forming liquid is primarily vaporized where it can be directly released from the liquid retention element, for example through perforations or openings in the susceptor tube. As a result, possibly generated bubbles are directly released and, thus, cannot perturb capillary liquid transport through the liquid retention element. Preferably, aerosol-forming liquid vaporized within the inner ring portion of the retention element is directly released into a central airflow passage that is formed by the cavity, that is, the inner void of the susceptor tube. Thus, vaporized aerosol-forming liquid may be entrained into the airflow passage and subsequently cool down to form an aerosol. Furthermore, a locally confined heating of the retention element advantageously prevents excessive heat propagation into other parts of the article, for example into a liquid reservoir containing aerosol-forming liquid (see below). This is particularly true when the susceptor element is intermittently heated, for example on a puff basis. Accordingly, adverse thermal altering effects of the aerosol-forming liquid within the reservoir can be avoided. Yet further, a confined local heating permits to reduce power consumption of the heating assembly. This proves advantageous with regard to the fact that inductive heating assemblies used in many aerosol-generating devices—like those according to the present invention—are typically powered by batteries which only have a limited energy capacity. Furthermore, due to the liquid retention element circumferentially surrounding the susceptor tube, the latter may advantageously serve as support and/or a sealing element covering the liquid retention element such as to prevent leakage of aerosol-forming liquid.

Advantageously, the ring-shaped liquid retention element is toroidal and/or hollow cylindrical. Preferably, the liquid retention element is toroidal and hollow cylindrical. That is, the ring-shaped susceptor element may be a revolution body resulting from a revolution of a rectangle around an axis of revolution. The height of the revolving rectangle determines the height, that is, the axial length extension of the ring-shaped liquid retention element. The distance between the axis of revolution and the inner edge of the revolving rectangle determines the inner radial extension of the ring-shaped liquid retention element. The distance between the outer edge of the revolving rectangle, that is, the sum of the inner radial extension and the length of the revolving rectangle as measured in the radial direction with regard to the axis of revolution, determines the outer radial extension of the ring-shaped liquid retention element.

In general, the height or the axial length extension of the ring-shaped liquid retention element may be equal to or larger than or smaller than the height or the axial length extension of the susceptor tube. Preferably, the height or axial length extension of the ring-shaped liquid retention element is chosen such that a radial inner face of the retention element is large enough to release a sufficient amount of vaporized aerosol-forming liquid.

The article may further comprise a housing which at least partially forms a liquid reservoir holding an aerosol-forming liquid. In particular, the liquid reservoir may be a ring-shaped liquid reservoir. As described above with regard to the liquid retention element, the liquid reservoir may be also toroidal and/or hollow cylindrical, thus facilitating a very compact and symmetric design. Preferably, the housing is made of a thermally insulting material and/or an electrically non-conductive and paramagnetic or diamagnetic material. Advantageously, this avoids overheating of the housing and/or undesired burn hazards.

In particular, the reservoir may comprise a ring-shaped inner wall and a ring-shaped outer wall surrounding the inner wall at a distance such as to form a ring-shaped or hollow cylindrical reservoir therebetween for storing aerosol-forming liquid. The ring-shaped outer wall may be part of or form at least a portion of a housing of the aerosol-generating article.

Preferably, the ring-shaped inner wall forms a central air passage extending through the reservoir along a center axis of the heating assembly. The central air passage may be tubular, in particular cylindrical. For example, the inner radial extension of the central air passage, that is, of the ring-shaped liquid reservoir may be between 1 mm (millimeter) and 3 mm (millimeter), preferably about 2 mm (millimeter). Preferably, the radius of the central air passage, that is, of the ring-shaped liquid reservoir is equal to the inner radial extension of the susceptor tube. Of course, the radius of the central air passage, that is, of the ring-shaped liquid reservoir may also be larger or smaller than the inner radial extension of the susceptor tube.

Preferably, the reservoir comprises or is made of an inductively non-heatable, in particular electrically non-conductive and paramagnetic or diamagnetic material. Even more preferably, the reservoir comprises or is made of a thermally insulting material. Advantageously, this prevents undesired overheating of the aerosol-forming liquid and/or burn hazards.

The reservoir may be open at an axial end face. That is, the reservoir may have an opening, for example at an axial end face. Preferably, the opening is ring-shaped. In case the article includes a liquid retention element as described above, the liquid retention element preferably is arranged at least partially within the reservoir, in particular within the opening of the liquid reservoir, thus allowing the liquid retention element to be in direct contact with aerosol-forming liquid contained in the reservoir.

Yet, the ring-shaped liquid retention element does not necessarily provide a sealing of the opening of the liquid reservoir due to its capillary properties. Therefore, the susceptor tube may provide a lateral cover or sealing element for the inner liquid retention element, as already described above. Furthermore, one or more seals, for example sealing gaskets, may be provided about the contact/mounting area of the housing of the article, in particular of the wall(s) of the liquid reservoir and the liquid retention element. This further improves the leak tightness of the liquid reservoir.

In addition, the article may comprise at least one holding element for mounting the susceptor assembly and/or the liquid retention element in the article. Preferably, the holding element may be made of thermally insulting material.

In particular, the article may comprise an axial end cover (as holding element) that is arranged at an axial end face of the ring-shaped liquid retention element, opposite to the reservoir volume. The axial end cover may form at least partially an axial end face of the reservoir. Preferably, the axial end cover may also be ring-shaped.

Alternatively and additionally, the article may comprise an axial support element (as holding element) that is arranged at another axial end face of the ring-shaped liquid retention element, facing the reservoir volume, that is, opposite to the axial end cover, if present. Preferably, the axial support element may also be ring-shaped. To allow aerosol-forming substrate to readily pass form the reservoir volume to the liquid retention element, the axial support element may be fluid permeable, in particular may comprise at least one opening and/or may be perforated.

At least one of the axial end cover and the axial support element may extend between a radial-inner portion and a radial-outer portion of the housing of the article, for example between a radial-inner and a radial-outer wall of the liquid reservoir. This configuration proves particularly advantageous with regard to the mechanical stability of the liquid reservoir. In order to ensure proper mounting of the axial end cover and/or the axial support element to the housing of the article, a radial outer face of the end cover and/or the axial support element may be recessed in an outer wall of the housing of the article. Alternatively, the end cover and/or the axial support element may be mounted to an outer wall of the housing of the article by rivet-like fixing means. Likewise, a radial outer face of the retention element may be recessed in an outer wall of the housing of the article. The same may also hold with regard to an inner wall of the housing of the article, in particular a radial-inner wall of the liquid reservoir.

At least one of the axial end cover and the axial support element may comprise, in particular consists of plastics, preferably a thermally stable or thermoplastic polymer, for example polyimide (PI) or polyether ether ketone (PEEK). Alternatively, at least one of the axial end cover and the axial support element may also comprise a susceptor material, that is, an electrically conductive and/or ferromagnetic or ferrimagnetic material.

As described above, the article preferably comprises a central air channel extending through the liquid reservoir and the cavity of the multi-layer susceptor tube.

As used herein, the terms “radial”, “axial” and “coaxial” refer to a center axis of the article. This center axis may be a symmetry axis the ring-shaped retention element and the susceptor tube. Accordingly, as used herein, the terms inner and outer radial extension refer to an extension measured from the center axis of the heating assembly. For example, the outer radial extension of the susceptor tube, the retention element or the induction coil refers to the radial distance between the center axis and a radial outermost edge of the susceptor element or of the induction coil, respectively. Likewise, the inner radial extension of the susceptor tube, the retention element or the induction coil refers to the radial distance between the center axis and a radial innermost edge of the susceptor element or of the induction coil, respectively.

As used in, the terms "ring-shaped", "ring shape" and "ring" refers to a circular or a circumferentially closed geometric body comprising a central inner void around a center axis. The outer radial extension of the ring or ring shape preferably is larger than the axial extension of the ring or ring shape. That is, the ring or ring shape preferably is flat. Of course, the outer radial extension of the ring or ring shape may be also smaller than the axial extension of the ring or ring shape.

Furthermore, the aerosol-generating article may comprise a mouthpiece. Preferably, the mouthpiece includes an outlet in fluid communication with a central air passage formed by the central void of the susceptor tube and the liquid reservoir (if present). Even more preferably, the mouthpiece may be integral with a liquid reservoir. In particular, the mouthpiece may be a proximal end portion of the liquid reservoir, preferably a tapered end portion of the liquid reservoir. This proves advantageous with regard to very compact sign of the aerosol-generating article.

The liquid reservoir may also form a housing or outer shell of the article. The article according to this configuration may be inserted into a receiving cavity or attached to a proximal end portion of an aerosol-generating device. For attaching the aerosol-generating article to an aerosol-generating device, a distal end portion of the aerosol-generating device may comprise a magnetic or mechanical mount, for example a bayonet mount or a snap-fit mount, which engages with a corresponding counterpart at a proximal end portion of the aerosol-generating device.

Alternatively, the aerosol-generating article may not comprise a mouthpiece. The article according to this configuration may be readily prepared for insertion into a receiving cavity or a recess or an article mount of an aerosol-generating device. A proximal open end of the receiving cavity or recess or mount (used for insertion of the article) may be closed by a mouthpiece which belongs to the aerosol-generating device. Alternatively, the aerosol-generating article may be attached to a main body of the aerosol-generating device and received in a cavity formed by a mouthpiece of the aerosol-generating device upon mounting the mouthpiece to the main body.

In either one of these configurations, when the article is inserted or attached to the device, the central airflow passage formed by the central void of the susceptor tube and the liquid reservoir (if present) preferably is in fluid communication with an air path extending through the aerosol-generating device. Preferably, the device comprises an air path extending from the at least one air inlet through the receiving cavity (if present) to at least one air outlet, for example to air outlet in the mouthpiece (if present).

As described above, the induction coil preferably is part of the aerosol-generating device. This facilitates powering of the induction coil. However, the induction coil may be integral part of the aerosol-generating article. In this configuration, the induction coil preferably comprises a connector to be electrically connected to an induction source of an aerosol-generating device. The connector is configured such that it automatically engages with a corresponding connector of the aerosol-generating device upon coupling the aerosol-generating article to the aerosol-generating device.

As mentioned before, it is the aerosol-generating device which preferably comprises an induction source for powering the induction coil. The induction source may comprise an alternating current (AC) generator. The AC generator may be powered by a power supply of the aerosol-generating device. The AC generator is operatively coupled to the induction coil. The AC generator is configured to generate a high frequency oscillating current to be passed through the induction coil for generating an alternating magnetic field. As used herein, a high frequency oscillating current means an oscillating current having a frequency between 500 kHz and 30 MHz, preferably between 1 MHz and 10 MHz and more preferably between 5 MHz and 7 MHz, most preferably at about 6.8 MHz.

The device may further comprise an electric circuitry which preferably includes the AC generator. The electric circuitry may advantageously comprise a DC/AC inverter, which may include a Class-D or Class-E power amplifier. The electric circuitry may be connected to an electrical power supply of the aerosol-generating device. The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of current to the induction coil. Current may be supplied to the induction coil continuously following activation of the system or may be supplied intermittently, such as on a puff by puff basis.

As also mentioned before, the aerosol-generating device advantageously comprises a power supply, preferably a battery such as a lithium iron phosphate battery. As an alternative, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction coil.

Further features and advantages of the aerosol-generating article according to the invention have been described with regard to susceptor assembly and the heating assembly according to the invention and as described herein. Therefore, these further features and advantages will not be repeated.

According to the invention there is also provided an aerosol-generating system comprising at least one of a susceptor assembly, an inductive heating assembly and an aerosol-generating article according to the invention and as described herein, wherein each of the article and the heating assembly comprises a susceptor assembly according to the invention and as described herein. The heating assembly further comprises an induction coil coaxially arranged or arrangeable inside the cavity of the multi-layer susceptor tube of the susceptor assembly.

Preferably, the aerosol-generating system includes an aerosol-generating device and aerosol-generating article which is configured for interaction with the device. In particular, the article may be an aerosol-generating article according to the invention and as described herein which comprises a susceptor assembly according to the invention and as described herein. The susceptor assembly in turn may be part of a heating according to the invention and as described herein.

Likewise, the aerosol-generating system may include a heating assembly according to the invention and as described herein. Preferably, the susceptor assembly of the heating assembly is part of an aerosol-generating article, whereas the induction coil of the heating assembly—that is arranged or arrangeable inside the cavity of the multi-layer susceptor tube of the susceptor assembly—is part of an aerosol-generating device.

Further features and advantages of the aerosol-generating system according to the invention have been described above with regard to the susceptor assembly, the heating assembly and the aerosol-generating article according to the present invention. Therefore, these further features and advantages will not be repeated.

The invention will be further described, by way of example only, with reference to the accompanying drawings, in which.

Figure 1:
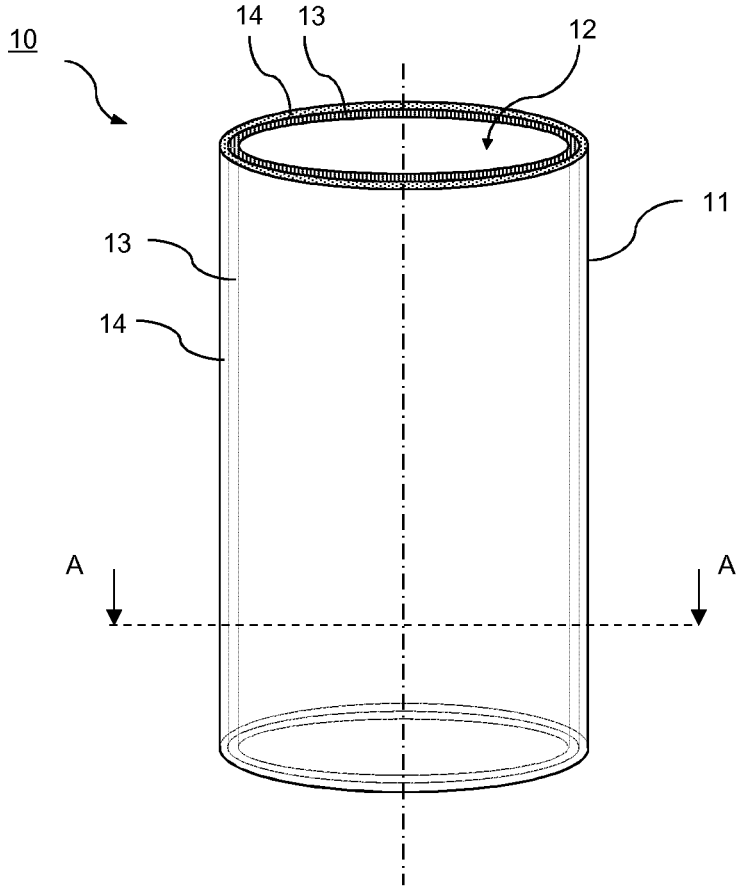
FIG. 1 is a schematic perspective view of a susceptor assembly according to a first embodiment of the invention.
Figure 2:
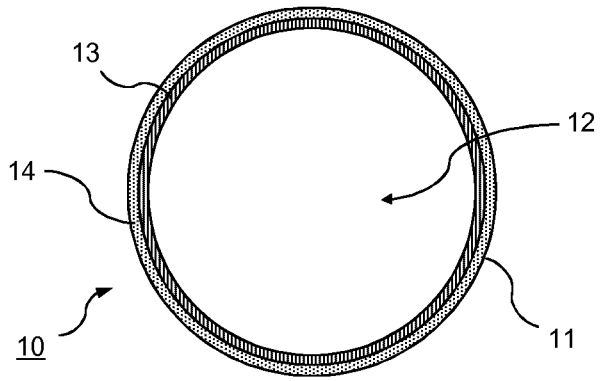
FIG. 2 is a schematic cross-sectional view of the susceptor assembly according to FIG. 1 along line A-A.

FIGS. 1-2 schematically illustrate a first embodiment of a susceptor assembly 10 according to the present invention. According to the invention, the susceptor assembly 10 comprises a multi-layer susceptor tube 11 which defines a cavity 12 for receiving an induction coil inside the susceptor tube 12 (shown in FIG. 3). As can be seen from FIGS. 1 and 2, the susceptor tube 11 according to the present embodiment has a substantially hollow-cylindrical shape including a substantially circular cross-section, wherein the inner void of the hollow cylinder of the susceptor tube 11 substantially forms the cavity 12 for receiving the induction coil (shown in FIG. 3, not shown in FIGS. 1 and 2). According to the invention, the multi-layer susceptor tube 11 further comprises an inner tubular layer 13 which includes a first electrically conductive material, and an outer tubular layer 14 surrounding the inner tubular layer 13 which includes a second electrically conductive material. Accordingly, the multi-layer susceptor tube 11 of the present embodiment is a two-layer or bi-layer susceptor tube. An electrical resistivity of the first electrically conductive material is larger than an electrical resistivity of the second electrically conductive material. Due to this, the outer layer 14 substantially serves to concentrate/block the alternating magnetic field due to its larger conductivity. In contrast, the inner layer 13 mainly serves to convert the energy of the magnetic field into heat due to its higher resistivity. As a result, the susceptor assembly 10 is capable of using more efficiently the energy of the alternating magnetic field provided by an induction coil arranged within the cavity 12 of the susceptor tube 11. In the present embodiment of the susceptor assembly 10, the inner tubular layer 13 is made of stainless steel (as a first electrically conductive material) having a resistivity of about 6.9×10E-07 Ohm-meter at room temperature (20° C.), whereas the outer tubular layer 14 is made of aluminum (as a second electrically conductive material) having a resistivity of about 2.65×10E-08 Ohm-meter at room temperature (20° C.).

Figure 3:
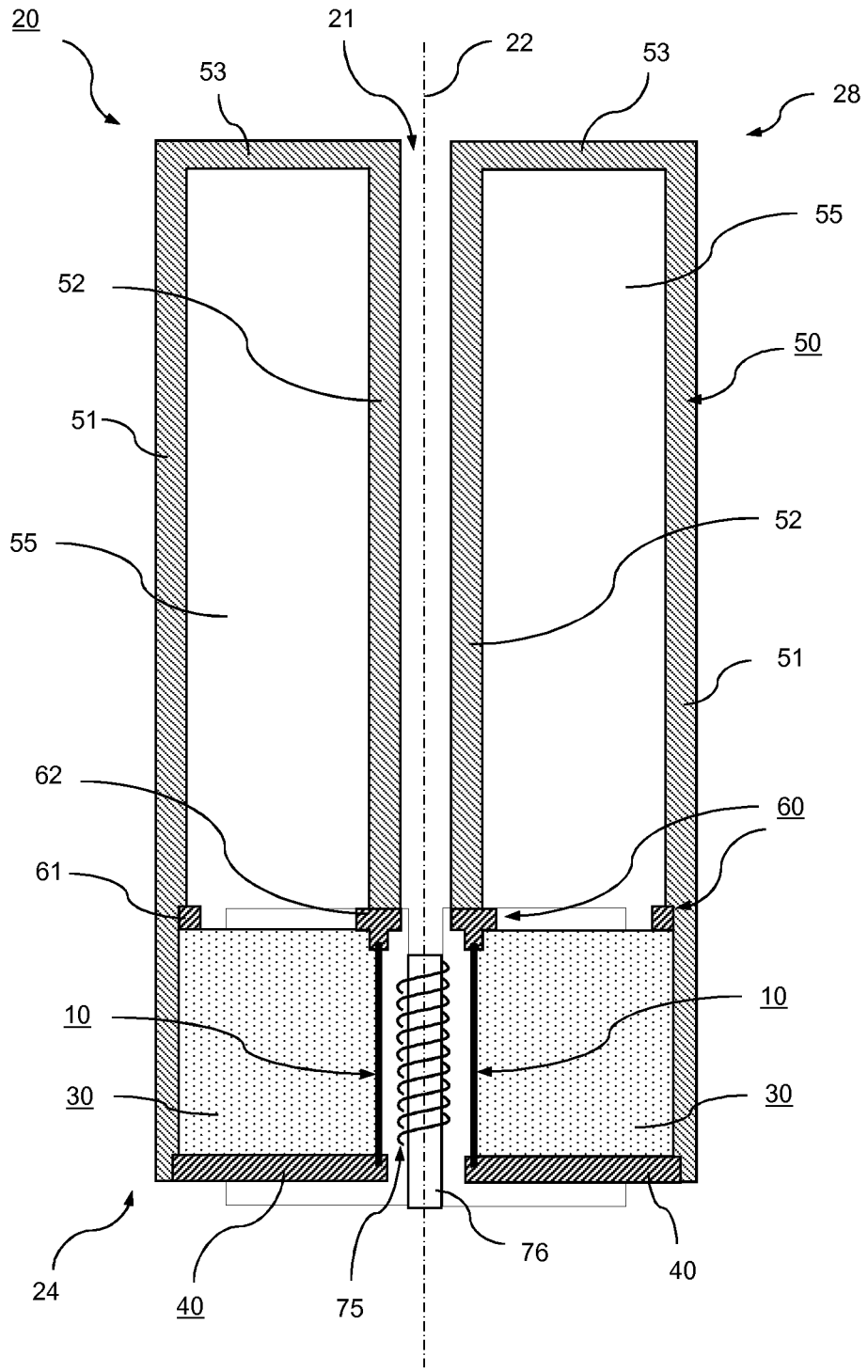
FIG. 3 is a schematic cross-sectional view of an exemplary embodiment of an aerosol-generating article comprising the susceptor assembly according to FIG. 1.
Figure 4:
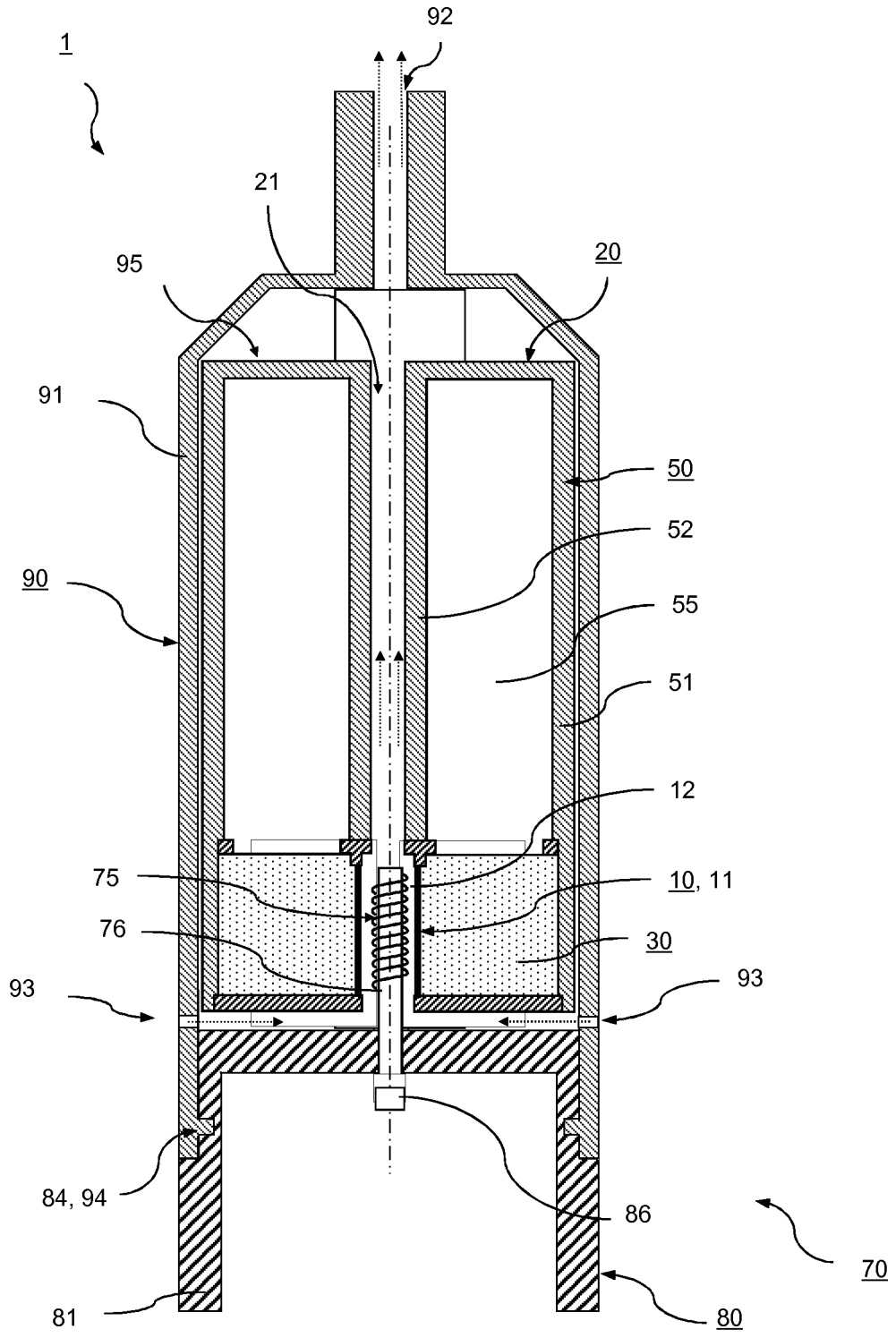
FIG. 4 is a schematic cross-sectional view of an exemplary embodiment of an aerosol-generating system comprising an aerosol-generating device and the aerosol-generating article according to FIG. 3.

FIG. 3 schematically illustrates an aerosol-generating article 20 comprising a susceptor assembly 10 according to the exemplary embodiment shown in FIG. 1. As illustrated in FIG. 4 the aerosol-generating article 60 is configured for use with an aerosol-generating device 70, wherein the device 70 and the article 20 together form an aerosol-generating system 1. The aerosol-generating article 20 includes a liquid reservoir 50 for holding aerosol-forming liquid to be vaporized using the susceptor assembly 10. In the present embodiment, the reservoir 50 has a substantially hollow cylindrical shape formed by a ring-shaped outer wall 51, a ring-shaped inner wall 52 and a proximal end wall 53 at the proximal end 28 of the article 20. The outer wall 51, the inner wall 52 and the proximal end wall 53 of the reservoir substantially form a housing of the article 20. Furthermore, the ring-shaped inner wall 52 forms a central air passage 21 through the reservoir 50 extending along a center axis 22 of the article 20. At the distal end 24 of the article 20, the reservoir 50 has an opening closed by a ring-shaped liquid retention element 30. The liquid retention element 30 is configured for holding and transporting aerosol-forming liquid stored in the ring-shaped reservoir volume 55 of the hollow cylindrical reservoir 50. Advantageously, the liquid retention element 30 is in direct contact with aerosol-forming liquid contained in the reservoir 50 due to its arrangement within the opening of the reservoir 50. Preferably, the liquid retention element 30 comprises or even consists of a high retention or high release material (HRM), for example a porous ceramic material. Preferably, the material of the liquid retention element is inductively non-heatable, in particular electrically non-conductive and paramagnetic or diamagnetic. Advantageously, this prevents undesired overheating of the aerosol-forming liquid.

For heating and vaporizing the aerosol-forming liquid within the liquid retention element 30, a tubular susceptor assembly 10 according to FIGS. 1 and 2 is coaxially arranged at a radial inner face of the liquid retention element 30. That is, liquid retention element 30 is circumferentially arranged around the multi-layer susceptor tube 11 with regard to the center axis 22 of the article 20. Preferably, the susceptor assembly 10 is in direct physical and thus thermal contact with the radial inner face of the liquid retention element 30. To allow aerosol-forming substrate vaporized in close proximity to the tubular susceptor assembly 10 for readily escaping from the liquid retention element 30 through the tubular susceptor assembly 10 into the cavity 12 or inner void of the susceptor tube 11 and, thus, into the central air passage 21, the susceptor tube 11 is fluid permeable. For example, the susceptor tube 11 may be perforated and/or may comprise at least one opening. In particular, the inner and outer tubular layers 13, 14 may include a tubular mesh comprising or consisting of the respective electrically conductive materials.

With reference to FIG. 3, the cavity 12 of the susceptor tube 11 is configured for receiving an induction coil 75 which belongs to the aerosol-generating device 70, which the aerosol-generating article 2 is configured for use with. The cavity 12 of the susceptor tube 11 also provides an airflow passage, in particular forms at least a portion of the central air passage 21 through the aerosol-generating article 20.

As can be also seen from FIG. 3, the length extension of the ring-shaped inner wall 52 of the liquid reservoir 50 is shorter than the length extension of the outer wall 51. Accordingly, the tubular susceptor assembly 10 forms at least a portion of an inner radial face of the liquid reservoir. At the same time, the tubular susceptor assembly 10 also provides a radial inner sealing cover for the liquid retention element 30. In order to further improve leak tightness of the liquid reservoir 50, seal elements (not shown) may be provided about the contact area between the inner and outer walls 51, 52 of the liquid reservoir 50 and the liquid retention element 30.

In order to ensure proper mounting of the ring-shaped liquid retention element 30 and the tubular susceptor assembly 10 in the article 20, the article 20 comprises holding elements made of thermally insulting material. In the present embodiment shown in FIG. 3, the article 20 comprises an axial end cover 40 (as holding element) that is arranged at an axial end face of the ring-shaped liquid retention element 30, opposite to the reservoir volume 55. The axial end cover 40 forms at least partially an axial end face of the reservoir 50. The axial end cover 40 is disc-shaped or ring-shaped having a central inner void such as to form at least a portion of the central air passage 21 through the aerosol-generating article 20. Moreover, the axial end cover 40 provides an axial sealing cover for the liquid retention element 30 which proves advantageous as the liquid retention element 30 typically does not provide sufficient sealing of the liquid reservoir 50 due to its capillary properties. In general, the radial inner and radial outer extensions of the ring-shaped end cover 40 may substantially correspond to the radial inner and radial outer extensions of the ring-shaped liquid reservoir 50.

Additionally, the article 20 comprises an axial support element 60 (as holding element) that is arranged at another axial end face of the ring-shaped liquid retention element 30, facing the reservoir volume 55, that is, opposite to the axial end cover 40. In the present embodiment, the axial support element 60 includes an outer and an inner support ring 61, 62, mounted to the ring-shaped outer and inner walls 51, 52 of the reservoir 50. Both, the outer and inner support rings 61, 62 provide a sealing about the contact area between the outer and inner walls 51, 52 of the liquid reservoir 50 and the liquid retention element 30. Advantageously, this improves leak tightness of the liquid reservoir 50. The outer and inner support rings 61, 62 may be linked by a plurality of radially extending bridge elements (not shown).

Further with reference to FIG. 3, the radial outer faces of the end cover 40, the outer support ring 61 of the axial support element 60 and the liquid retention element are recessed in an outer wall 51 of the reservoir 50 in order to ensure proper mounting to the housing of the article 20. Likewise, the inner support ring 62 of the axial support element 60 is mounted to an axial end face of the inner wall 52 of the reservoir 50. Alternatively, the end cover 40 and/or the axial support element 60 may be mounted to the outer and/or inner wall 51, 52 of the reservoir 50 by rivet-like fixing means. As can be particularly seen from FIG. 3, the axial support element 60 and the axial end cover 40 serve to hold the tubular susceptor assembly 10 in-between. In particular, the axial end portions of the susceptor tube 11 are recessed in a radial inner portion of the axial end cover 40 and the inner support ring 62, respectively. For this, the inner support ring 62 comprises a circumferential protrusion, extending in an axial direction towards the axial end cover 40, causing the inner support ring 62 to have a substantially T-shaped cross-section. The entire configuration described above proves particularly advantageous with regard to the mechanical stability of the liquid reservoir.

The axial end cover 40 and the axial support element 60 consists of plastics, preferably a thermally stable or thermoplastic polymer, for example polyimide (PI) or polyether ether ketone (PEEK).

To inductively heat the susceptor assembly 10 and thus to vaporized aerosol-forming liquid within the retention element 30, an induction coil 75 can be or is arranged in the cavity 12 of the susceptor assembly 10, that is, within the central airflow passage at the distal end of the aerosol-generating article 20. The induction coil 75 is configured for generating an alternating magnetic field within the susceptor assembly 10. In the present embodiment, the induction coil 40 is helical coil wound around a cylindrical coil support 76 that is preferably made of a ferrite material for concentrating the magnetic flux. In particular, a height or axial length extension of the susceptor tube 11 is slighter larger than a height or axial length extension of the induction coil 75 such that the induction coil 75 is fully enclosed within the multi-layer susceptor tube 11. Thus, coupling of an alternating magnetic field generated by the induction coil 75 to the susceptor tube 11 is significantly increased.

In general, the induction coil 75 may be either part of the article 20 or—as in the present embodiment shown in FIG. 3—part of the aerosol-generating device 70 which is configured for interaction with the aerosol-generating article 20. Regardless of whether the induction coil 75 is part of the article 20 or the device 70, the induction coil 75 and the susceptor assembly 10 form together an induction heating assembly according to the present invention.

FIG. 4 schematically illustrates at least a portion of an aerosol-generating device 70 according to a first embodiment of the present invention. The device 70 is configured for interaction with the aerosol-generating article 20 according to FIG. 3. The article 20 and the device 70 together form an aerosol-generating system 1. The aerosol-generating device 70 comprises the induction coil 75 for generating an alternating magnetic field within the susceptor assembly 10, as mentioned above. For powering the induction coil 75, the aerosol-generating device 70 may further comprise an induction source (not shown) including an alternating current (AC) generator that is powered by a battery (not shown).

Further with reference to FIG. 4, the aerosol-generating device 70 comprises a main body 80 and a mouthpiece 90. The mouthpiece 90 is releasably attachable to the main body 80. For this, the main body 80 and the mouthpiece 90 comprise corresponding bayonet mounts 84, 94 that are arranged at opposing ends of the walls 81, 91 of the main body 80 and the mouthpiece 90, respectively. The mouthpiece 90 defines a cavity 95 for accommodating the aerosol-generating article 20 such as to be securely mounted in the aerosol-generating device 70. Once the aerosol-generating article 20 is attached to the aerosol-generating device 70, the central airflow passage 21 formed by the central void of the ring-shaped liquid reservoir 50 and the susceptor tube 10 is in fluid communication with an air path extending through the aerosol-generating device 70. In the present embodiment, the air path (see dotted arrows in FIG. 4) extends from lateral air inlets 93 in the outer wall 91 of the mouthpiece 90 through the receiving cavity 95 to a central air outlet 92 at the proximal end of the mouthpiece 90.

The cylindrical coil support 76 holding the helical induction coil 75 is coaxially arranged in and attached to the main body 80, extending into the cavity 95 that is formed by the mouthpiece 90. The device 70 may further include a puff sensor 86 in the form of a microphone for detecting when a user puffs on the mouthpiece 90. The puff sensor 86 is in fluid communication with the air path and arranged within the main body 80 close to the point where the cylindrical coil support 76 is attached to the main body 80.

In use, a user may puff on the mouthpiece 90 to draw air though the air inlets 93 into the cavity 95 and out of the outlet 92 into the user's mouth. When a puff is detected by the puff sensor 86, the induction source provides a high frequency oscillating current to the coil 75 such as to generate an alternating magnetic field which passes through the susceptor assembly 10. As a consequence, the electrically conductive first and second materials of the susceptor tube 11 heat up due to eddy currents that are induced by the alternating magnetic field. In case the first and/more second material of the inner and/or outer layer 13, 14 of the multi-layer susceptor tube 11 is not only electrically conductive but also magnetic, heat is also generated by hysteresis losses. The susceptor assembly 10 heats up until reaching a temperature sufficient to vaporize the aerosol-forming liquid held in the liquid retention element 30. The vaporized aerosol-forming material passes through the fluid permeable susceptor tube 11 and is entrained in the air flowing from the air inlets 93 along the central air passage 61 towards the air outlet 92. Along this way, the vapor cools to form an aerosol within the mouthpiece 90 before escaping through the outlet 92. The induction source may be configured to power the induction coil 75 for a predetermined duration, for example five seconds, after detection of a puff and then switches the current off until a new puff is detected.

Figure 5:
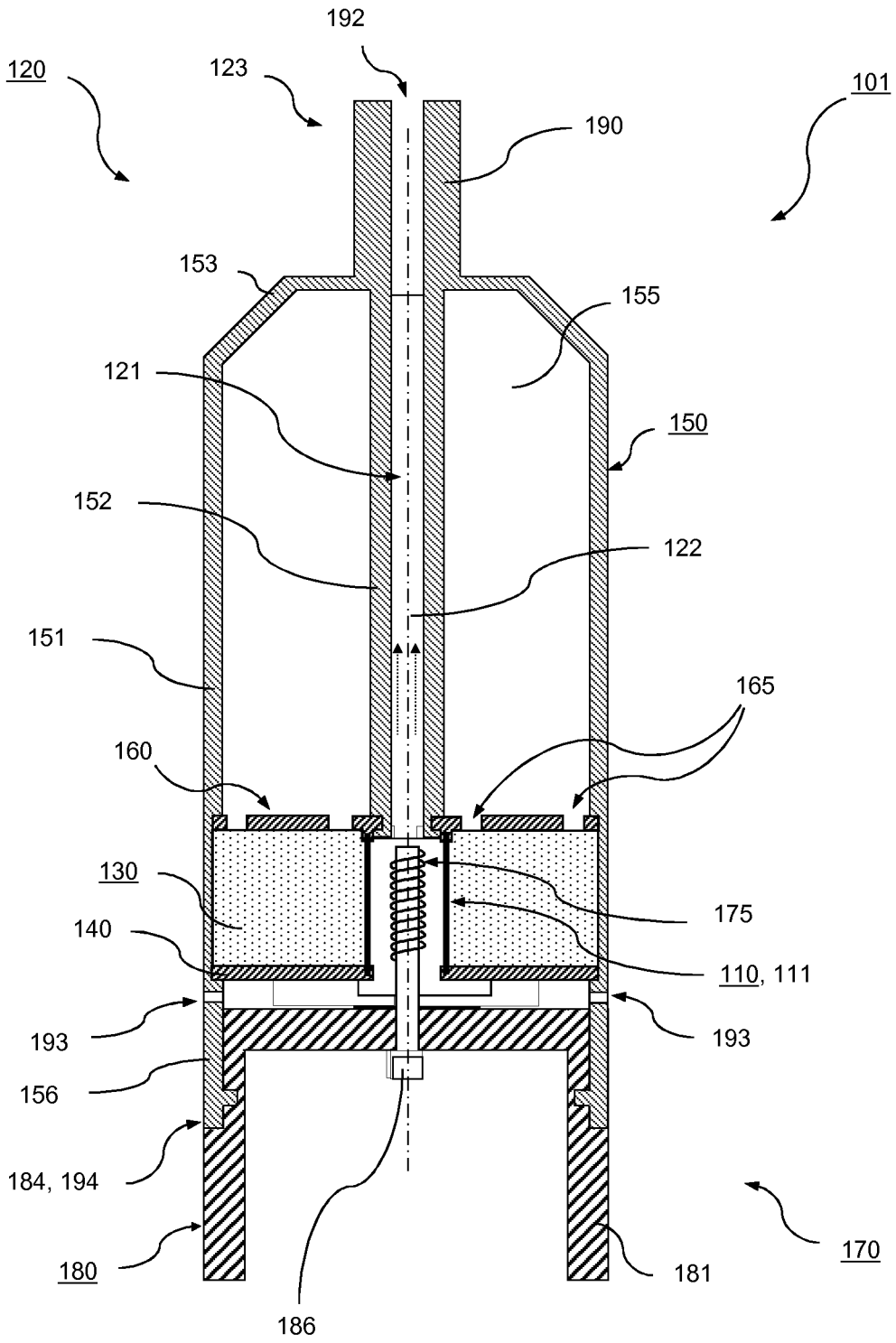
FIG. 5 is a schematic cross-sectional view of another exemplary embodiment of an aerosol-generating article comprising a susceptor assembly according to the invention.

FIG. 5 schematically illustrates another exemplary embodiment of an aerosol-generating system 101 comprising an aerosol-generating device 170 and an aerosol-generating article 120 according to a second embodiment the present invention. The device 170 is very similar to the device 70 according to FIG. 4, in particular with regard to the main bodies 80 and 380, respectively. Therefore, like or identical features are denoted with the same reference numerals as in FIG. 4, incremented by 100. Yet, in contrast to the device 70 according to FIG. 4, the device 170 according to FIG. 5 does not comprise a mouthpiece. Instead, it is the article 120 which comprises a cylindrical mouthpiece portion 190 at its proximal end 123 adjacent to the proximal end wall 153 of the liquid reservoir 150. In particular, the mouthpiece portion 190 is integral with the walls of the liquid reservoir 150. As can be seen in FIG. 5, the central air passage 121 through the void center of the reservoir 150 further extends through the center of the cylindrical mouthpiece portion 190 towards to an air outlet 192.

As can be further seen in FIG. 5, the outer wall 151 of the liquid reservoir 150 has a ring-shaped protrusion 156 axially extending beyond the liquid retention element 130 in a distal direction. At its distal end, the ring-shaped protrusion 156 comprises a bayonet mount 194 which engages with a corresponding bayonet mount 184 arranged at an opposing end of the walls 181 of the main body 180 of the device 170. Accordingly, it is the article 120 which comprises lateral air inlets 193 extending through the outer wall 151 close to the axial end cover 140. From there, an air path passes along the end face of the axial end cover 140 and the radial inner face of the susceptor tube 111 further through the central air passage 121 towards to the air outlet 192. Advantageously, the article 120 provides a very compact design.

Further in contrast to the aerosol-generating article 20 according to the first embodiment shown in FIGS. 3 and 4, the article 120 according to this second embodiment comprises a single piece axial support element 160, instead of an inner and outer support ring. The single piece axial support element 160 is a substantially flat ring-shaped disc extending between the outer and inner walls 151, 152 of the article 120. The support element 160 comprises a plurality of openings 165 such as to allow aerosol-forming substrate to readily pass form the reservoir volume 155 to the liquid retention element 130.

Apart from that, the article 120 according to FIG. 5 is very similar to the article 20 according to FIGS. 3 and 4. In particular, the susceptor assembly 110 and the liquid retention element 130 are substantially identical to the aerosol-generating article according to the first embodiment.

The invention claimed is:

1. A susceptor assembly for inductively heating an aerosol-forming substrate, the susceptor assembly comprising a multi-layer susceptor tube defining a cavity configured to receive an induction coil inside the multi-layer susceptor tube, wherein the multi-layer susceptor tube comprises an inner tubular layer, which includes a first electrically conductive material, and an outer tubular layer surrounding the inner tubular layer, which includes a second electrically conductive material, wherein an electrical resistivity of the first electrically conductive material is greater than an electrical resistivity of the second electrically conductive material.

2. The susceptor assembly according to claim 1, wherein the electrical resistivity of the first electrically conductive material is at least 2.5×10E-08 Ohm-meter at a temperature of 20° C.

3. The susceptor assembly according to claim 1, wherein the electrical resistivity of the first electrically conductive material is at least 5.0×10E-07 Ohm-meter at a temperature of 20° C.

4. The susceptor assembly according to claim 1, wherein the electrical resistivity of the first electrically conductive material is at least two times greater than the electrical resistivity of the second electrically conductive material.

5. The susceptor assembly according to claim 1, wherein the electrical resistivity of the first electrically conductive material is at least ten times greater than the electrical resistivity of the second electrically conductive material.

6. The susceptor assembly according to claim 1, wherein the multi-layer susceptor tube is fluid-permeable.

7. The susceptor assembly according to claim 6, wherein the multi-layer susceptor tube is perforated.

8. The susceptor assembly according to claim 1, wherein at least one of the first and the second electrically conductive materials is ferromagnetic or ferrimagnetic.

9. The susceptor assembly according to claim 1, further comprising an end cover disposed at an axial end face of the multi-layer susceptor tube.

10. The susceptor assembly according to claim 9, wherein the end cover comprises at least one opening and/or is perforated.

11. An inductive heating assembly for inductively heating an aerosol-forming substrate, the inductive heating assembly comprising a susceptor assembly according to claim 1 and an induction coil coaxially arranged or arrangeable inside the cavity of the multi-layer susceptor tube, so as to be fully enclosed within the multi-layer susceptor tube.

12. The inductive heating assembly according to claim 11, wherein a minimum radial distance between the multi-layer susceptor tube and the induction coil, when arranged inside the susceptor tube, is in a range of 0.05 millimeter to 0.3 millimeter.

13. The inductive heating assembly according to claim 11, wherein a minimum radial distance between the multi-layer susceptor tube and the induction coil, when arranged inside the susceptor tube, is in a range of 0.1 millimeter to 0.2 millimeter.

14. An aerosol-generating article for an aerosol-generating device, the aerosol-generating article comprising an aerosol-forming substrate and a susceptor assembly according to claim 1, and being in thermal contact with at least a portion of the aerosol-forming substrate.

15. The aerosol-generating article according to claim 14, wherein the aerosol-forming substrate is an aerosol-forming liquid, and wherein the aerosol-generating article further comprises a ring-shaped liquid retention element circumferentially arranged around the multi-layer susceptor tube and configured to hold and to transport at least a portion of the aerosol-forming liquid.

16. The aerosol-generating article according to claim 15, further comprising a housing at least partially forming a liquid reservoir holding the aerosol-forming liquid, wherein the ring-shaped liquid retention element is arranged at least partially within an opening of the liquid reservoir.

17. The aerosol-generating article according to claim 15, further comprising a housing at least partially forming a ring-shaped liquid reservoir holding the aerosol-forming liquid, wherein the ring-shaped liquid retention element is arranged at least partially within an opening of the ring-shaped liquid reservoir.

18. The aerosol-generating article according to claim 16, further comprising a central air channel extending through the liquid reservoir and the cavity of the multi-layer susceptor tube.

19. The aerosol-generating article according to claim 17, further comprising a central air channel extending through the ring-shaped liquid reservoir and the cavity of the multi-layer susceptor tube.

20. The aerosol-generating article according to claim 14, further comprising at least one holding element made of thermally insulting material configured to mount the susceptor assembly in the aerosol-generating article.

21. An aerosol-generating system, comprising:

at least one of a susceptor assembly for inductively heating an aerosol-forming substrate, an inductive heating assembly for inductively heating the aerosol-forming substrate, and an aerosol-generating article for an aerosol-generating device, the susceptor assembly comprising a multi-layer susceptor tube defining a cavity configured to receive an induction coil inside the multi-layer susceptor tube, wherein the multi-layer susceptor tube comprises an inner tubular layer, which includes a first electrically conductive material, and an outer tubular layer surrounding the inner tubular layer, which includes a second electrically conductive material, wherein an electrical resistivity of the first electrically conductive material is greater than an electrical resistivity of the second electrically conductive material;

the inductive heating assembly comprising the susceptor assembly and an induction coil coaxially arranged or arrangeable inside the cavity of the multi-layer susceptor tube, so as to be fully enclosed within the multi-layer susceptor tube; and the aerosol-generating article comprising the aerosol-forming substrate and the susceptor assembly, and being in thermal contact with at least a portion of the aerosol-forming substrate.

* * * * *